US005088542A

United States Patent [19]

Biba et al.

[11] Patent Number: 5,088,542

[45] Date of Patent: Feb. 18, 1992

[54] VERTICAL BLIND APPARATUS

[75] Inventors: Scott I. Biba, Mazomanie; Dean R. Sommerfeld, Cottage Grove, both of Wis.

[73] Assignee: Graber Industries, Inc., Middleton, Wis.

[21] Appl. No.: 733,623

[22] Filed: Jul. 22, 1991

[51] Int. Cl.[5] ..... E06B 9/30

[52] U.S. Cl. ..... 160/168.1; 160/901

[58] Field of Search ..... 160/168.1, 173, 176.1, 160/178.1, 172, 84.2, 84.3, 900, 901

[56] References Cited

U.S. PATENT DOCUMENTS

| | | | |
|---|---|---|---|
| 2,759,534 | 8/1956 | Harju | 160/168.1 |
| 2,822,043 | 2/1958 | Horak | 160/172 |
| 3,280,891 | 3/1964 | Eldredge, Jr. et al. . | |
| 3,534,801 | 10/1970 | Bolden | 160/176.1 X |
| 4,122,884 | 10/1978 | Salzmann . | |
| 4,628,981 | 12/1986 | Ciriaci et al. | 160/168.1 X |
| 4,657,060 | 4/1987 | Kaucic . | |
| 4,799,527 | 1/1989 | Villoch et al. | 160/168.1 |
| 4,834,163 | 5/1989 | Dickstein | 160/176.1 |
| 4,848,435 | 7/1989 | Helver | 160/176.1 |

*Primary Examiner*—David M. Purol

*Attorney, Agent, or Firm*—Vernon J. Pillote

[57] ABSTRACT

A vertical blind apparatus of the type having a plurality of panel support carriages mounted for movement along a track and a lazy-tong linkage extending lengthwise of the track and connected to the carriages to control spacing between adjacent carriages when the blind is extended along the track to a closed position. The maximum spacing between adjacent carriages is further controlled by rail engaging fingers on the outer pivots of the lazy-tong linkage, and a rail having lateral guide faces arranged to engage the fingers to limit movement of the outer pivots to a preselected minimum distance.

8 Claims, 1 Drawing Sheet

VERTICAL BLIND APPARATUS

BACKGROUND OF THE INVENTION

It is known, for example as disclosed in U.S. Pat. No. 3,280,891, to provide vertical blind apparatus having a plurality of panel support carriages movable along a track with a lazy-tong type linkage for interconnecting the carriages to control spacing between the panel support carriages as the vertical blind apparatus is traversed along the track from an open to a closed position. However, because of the necessary working clearances between the numerous levers and the pivots that interconnect the levers, the lazy-tong linkage usually exhibits a certain amount of looseness such that it does not maintain uniform spacing between the panel support carriages connected to the lazy-tong linkage. This problem is particularly aggravated in installations in which the carriage guide track is mounted at an angle to the horizontal. In such installations, the panel support carriages tend to bunch toward the lower end of the track when the carriages are traversed to an extended position across the window opening.

SUMMARY OF THE INVENTION

It is an object of the present invention to provide a vertical blind apparatus having a lazy-tong linkage means for controlling spacing of the panel support carriages along the track, and which has an improved arrangement for limiting the maximum spacing between the carriages when the blind apparatus is moved to an extended position.

Another object of this invention is to provide a vertical blind apparatus in accordance with the foregoing object, and in which the maximum spacing between the carriages in the blind closed position can be preset to accommodate windows of different width.

Accordingly, the present invention provides a vertical blind apparatus including an elongated carriage guide track and a plurality of panel support carriages mounted on the track for movement therealong and a lazy-tong linkage means extending lengthwise of the path. The carriages are connected to the lazy-tong linkage means at spaced locations therealong and a traverse mechanism is provided for moving a lead end of the lazy-tong linkage means along the path between the retracted blind open condition and an extended blind closed position. The maximum spacing between the carriages in the blind closed position is controlled by rail means extending parallel to the path of travel of the carriages and finger means on the lazy-tong linkage means for engaging the rail means to limit movement of the pairs of outer pivot means toward each other to a preselected minimum distance. The rail means provides a pair of lateral guide faces located between the outer pivots of the lazy-tong linkage means and the finger means preferably comprise pairs of finger means fixed to at least some of the pairs of outer pivots that interconnect the adjacent pairs of levers of the lazy-tong linkage, and the pair of lateral guide faces are spaced apart a preselected distance less than the spacing between the outer pivots when the lazy-tong linkage means is in a retracted blind open condition.

The rail means is advantageously arranged so that the spacing between the lateral guide faces can be changed to adjust the maximum spacing between the carriages when the lazy-tong linkage means is in an extended condition.

DETAILED DESCRIPTION OF THE INVENTION

Figure 1:
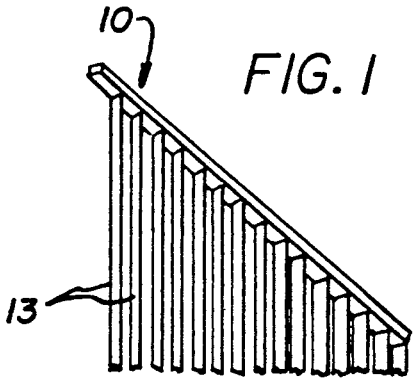
FIG. 1 is a perspective view illustrating a vertical blind apparatus installed with a headrail disposed at an angle to the horizontal.

The vertical blind apparatus in general includes an elongated headrail 10 providing a carriage guide track adapted to be mounted above a window opening and a plurality of carriages 11 mounted for movement in a path along the headrail. Each carriage has a slat carrier 12 supported thereon for rotation about an axis transverse to the headrail and the slide carriers are arranged to support the upper end of a slat or panel 13. A carriage traverse mechanism is provided for moving a lead one of the carriages along the headrail between a retracted blind open condition shown in FIG. 4 and an extended blind closed position shown in FIG. 5. In the embodiment illustrated, the traverse mechanism includes traverse cords 14 entrained over cord guides 15 and 16 mounted in end fittings 17 and 18 at opposite ends of the track 10. The traverse cords have one run connected to a lead or master carriage 11*a*, as by knotting or otherwise affixing the ends of the traverse cord to the carriage as indicated at 14*a*.

Figure 2:
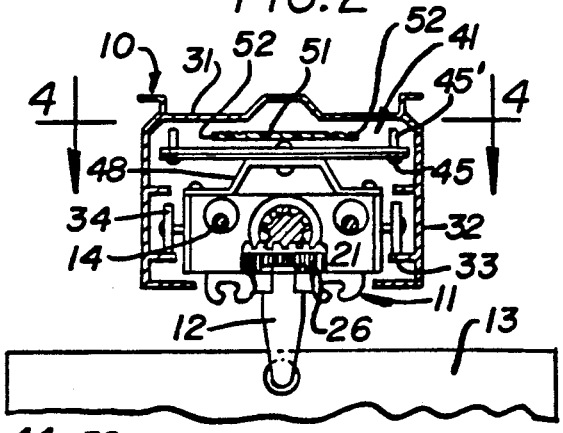
FIG. 2 is a transverse sectional view through the headrail of the vertical blind apparatus when the carriages are in a retracted or blind open position.
Figure 3:
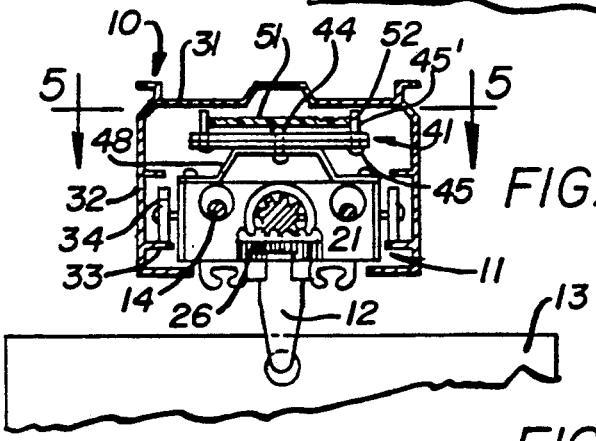
FIG. 3 is a transverse sectional view through the headrail of the vertical blind apparatus when the blind apparatus is in an extended or blind closed position.

A blind operating rod 21 is rotatably supported in end members 17 and 18. A rod operating mechanism is provided in the end member 17 and may, for example, comprise a speed reducing gear mechanism of the type disclosed in U.S. Pat. No. 4,657,060 for rotating the rod in response to pulling on one or the other of the vertical runs of an operating chain 25. A gear mechanism 26 is provided on each of the slide carriages for rotating the slat carriers 12 about a carrier axis in response to rotation of the operating rod about its axis. The carrier rotating means shown in FIGS. 2 and 3 is of the rack and pinion type such as disclosed in U.S. Pat. No. 4,122,884, it being understood that other carrier rotating mechanisms such as a worm and worm wheel type, may also be used.

The headrail 10 is preferably in the form of a downwardly opening channel having a top wall 31 and depending side walls 32 with rails 33 extending inwardly of the side walls to define the carriage guide tracks. The carriages 11 are supported by guides such as rollers or wheels 34 on the rail for movement along the tracks.

Figure 5:
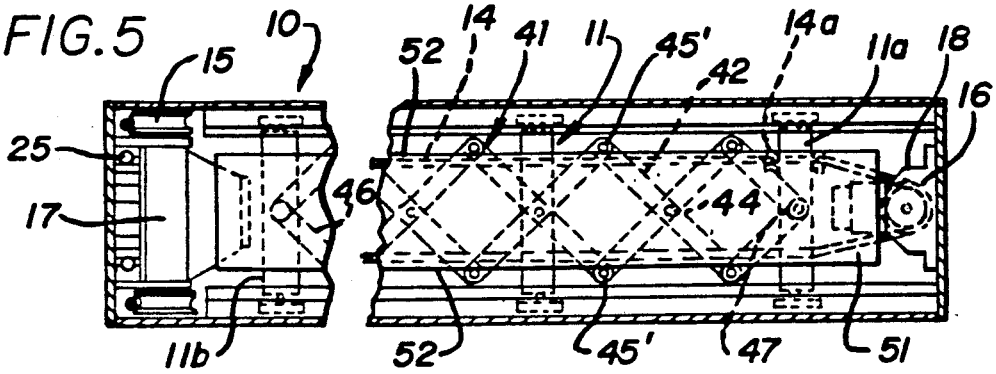
FIG. 5 is a fragmentary horizontal sectional view taken on the plane 5—5 of FIG. 3.

A lazy-tong type linkage mechanism 41 is provided for controlling spacing of the carriages along the tracks. As is conventional, the lazy-tong linkage includes a plurality of pairs of levers 42. A center pivot means 44 pivotally interconnects the levers of each pair intermediate their ends and pairs of outer pivot means 45 pivotally interconnect the ends of adjacent pairs of levers. The lazy-tong linkage means extends lengthwise of the path of travel of the carriages and as best shown in FIGS. 2 and 3, is disposed above the carriages and below the top wall 31 of the headrail. The carriages 11 are connected as by brackets 48 to the lazy-tong linkage at preselected ones of the center pivot means 44. The lazy-tong linkage is connected at one end by links 46 to a stationary one 11b of the carriages and the linkage is connected at its other end by links 47 (FIG. 5) to the lead carriage 11a. In order to minimize the overall size of the headrail required, it is common practice to make the lazy-tong linkage with relatively short levers 42 and to connect the carriages to alternate ones of the center pivots 44, as shown in FIG. 5. In some installations where the headrail is mounted at a substantial angle to the horizontal as shown in FIG. 1, the slats 13 that depend from the carriages will be spaced apart at a distance substantially less than the spacing of the carriages along the track and, in such installations, the carriages can be connected to each third center pivot.

Figure 4:
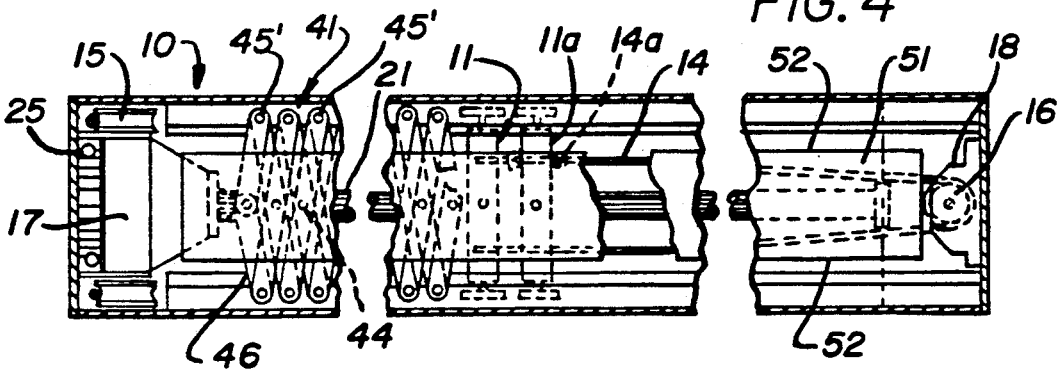
FIG. 4 is a fragmentary horizontal section view taken on the plane 4—4 of FIG. 2.

Because of the large number of levers in the lazy-tong linkage and the necessary clearance between the levers and the center pivots 44 and outer pivots 45, the lazy-tong linkage does not accurately maintain the carriages at a uniform spacing. When the headrail is mounted at an angle to the horizontal as shown in FIG. 1, the carriages are gravitationally urged toward the lower end of the headrail so that, when the vertical blind apparatus is in its extended or closed position as shown in FIG. 1, the spacing between the carriages in the upper portions of the headrail is greater than the spacing between the carriages at the lower portions of the headrail. When the blind apparatus is in its open position shown in FIGS. 2 and 4, the spacing between the outer pivots 45 is at a maximum and the spacing decreases as the blind apparatus is extended to its closed position as shown in FIGS. 3 and 5. In accordance with the present invention, provision is made for limiting the minimum spacing between the outer pivots 45 during extension of the blind, to thereby limit the maximum spacing between the carriages to a preselected distance. For this purpose an elongated rail 51 is provided to extend lengthwise of the path of travel of the carriages. In the preferred embodiment illustrated, the rail is in the form of an elongated strip disposed above the lazy-tong linkage and below the top wall of the channel, and which provides a pair of lateral guide faces 52 along opposite side edges. Pairs of rail engaging fingers are provided on the lazy-tong linkage at spaced locations therealong and arranged to engage the lateral guide faces 52 on the rail 51 to limit movement of the outer pivot means toward each other to a preselected minimum distance. The fingers are preferably formed as extensions 45' of the outer pivots 45, for example by using shouldered rivets. As will be seen from FIGS. 2 and 3, the fingers 45' project upwardly from the lazy-tong linkage means and the rail 51 is disposed between the fingers. The side edges 52 of the rail are spaced apart a distance substantially less than the spacing between the fingers 45 when the blind apparatus is retracted as shown in FIGS. 2 and 4, and the spacing of the edges is selected to control the minimum of spacing between the outer pivot means 45 and hence control the maximum spacing between adjacent carriages, when the blind apparatus is extended as shown in FIGS. 3 and 5. The rail can also be adjusted to change the minimum spacing between the outer pivots 45 and hence the maximum spacing of the carriages, to adapt the blind apparatus to windows of slightly different width. Thus, a small reduction in the spacing between the guide faces 52 will increase the spacing between adjacent carriages when the blind is extended, and vice versa. The rail 51 is preferably formed of a synthetic resin material and provided with longitudinally extending score lines to facilitate trimming small increments for example of the order of a few millimeters, from the side edges.

The rail 51 is advantageously mounted so that it can shift laterally of the headrail 10 to allow centering of the strip between the rail engaging fingers 45'. In the embodiment disclosed, the ends of the rail 51 rest on and are supported by the end members 17, 18 and loosely overlies the lazy-tong linkage intermediate its ends so that it can shift laterally of the headrail.

From the foregoing it is believed that the construction and operation of the vertical blind apparatus will be readily understood.

Rail engaging fingers 45' are fixed to or formed integrally with at least some of the pairs of outer pivots 45 of the lazy-tong linkage and the rail 51 provides lateral guide faces 52 that are spaced apart a distance less than the maximum spacing between the outer pivots 45 and such as to limit movement of the outer pivots toward each other to a preselected minimum distance to thereby control the maximum spacing between adjacent carriages when the blind is in an extended condition.

The embodiments of the invention in which an exclusive property or privilege is claimed are defined as follows:

1. A vertical blind apparatus including an elongated carriage guide track, a plurality of panel support carriages mounted on the track for movement in a path lengthwise of the track, lazy-tong linkage means extending lengthwise of said path and including a plurality of pairs of levers and center pivot means pivotally interconnecting the levers of each pair and pairs of outer pivot means pivotally interconnecting adjacent pairs of levers, means connecting the carriages to the lazy-tong linkage means, traverse means for moving a lead end of the lazy-tong linkage means along the path between a retracted blind open condition and an extended blind closed condition, the pairs of outer pivot means being spaced apart a first distance when the lazy-tong linkage means is in a retracted blind open condition, rail means extending parallel to said path, and finger means on said lazy-tong linkage means for engaging the rail means to limit movement of the pairs of outer pivot means toward each other to a preselected minimum distance less than said first distance when the lead end of the lazy-tong linkage means is moved toward the blind closed condition.

2. A vertical blind apparatus according to claim 1 wherein said rail means has first and second guide faces extending lengthwise of said path, said finger means comprising first and second rail engaging fingers on at least some of the pairs of levers respectively engageable with the first and second guide faces.

3. A vertical blind apparatus according to claim 1 wherein said finger means are integral with at least some of said outer pivot means.

4. A vertical blind apparatus including an elongated carriage guide track, a plurality of panel support carriages mounted on the track for movement in a path lengthwise of the track, lazy-tong linkage means extending lengthwise of said path and including a plurality of pairs of levers and center pivot means pivotally interconnecting the levers of each pair and pairs of outer pivot means pivotally interconnecting adjacent pairs of levers, means connecting the carriages to selected ones of the center pivot means, traverse means for moving a lead end of the lazy-tong linkage means along the path between a retracted blind open condition and an extended blind closed condition, the pairs of outer pivot means being spaced apart a first distance when the lazy-tong linkage means is in a retracted blind open condition, pairs of finger means fixed to at least some of the pairs of outer pivot means, and rail means providing a pair of lateral guide faces extending lengthwise of said path intermediate the outer pivot means for engaging the finger means to limit movement of the pairs of outer pivot means toward each other to a preselected minimum distance less than said first distance, when the lead end of the lazy-tong linkage means is moved toward the blind closed condition.

5. A vertical blind apparatus including an elongated headrail channel having a top wall and depending side walls and means providing carriage guide tracks on the side walls, a plurality of panel support carriages mounted on the tracks for movement in a path lengthwise of the channel, lazy-tong linkage means extending lengthwise of said path above said carriages and below the top wall, the lazy-tong linkage means including a plurality of pairs of levers and center pivot means pivotally interconnecting the levers of each pair and pairs of outer pivot means pivotally interconnecting adjacent pairs of levers, means connecting the carriages to the lazy-tong linkage means at preselected ones of the center pivot means, traverse means for moving a lead end of the lazy-tong linkage means along the path between a retracted blind open condition and an extended blind closed condition, the pairs of outer pivot means being spaced apart a first distance when the lazy-tong linkage means is in a retracted blind open condition, rail means above the lazy-tong linkage means and below the top wall providing a pair of lateral guide faces extending parallel to said path intermediate the outer pivot means and spaced apart a distance less than said first distance, pairs of rail engaging fingers fixed to at least some of the pairs of outer pivot means for engaging the lateral guide faces on the rail means to limit movement of the outer pivot means toward each other to a preselected minimum distance less than said first distance when the lead end of the lazy-tong linkage means is moved toward the blind closed condition.

6. A vertical blind apparatus according to claim 5 wherein said rail means comprises an elongated strip and the lateral guide faces are defined by opposite side edges of the strip.

7. A vertical blind apparatus according to claim 6 wherein said strip is formed of synthetic resin material and has lengthwise extending score lines to facilitate trimming of the strip to a different width.

8. A vertical blind apparatus according to claim 5 wherein the rail means comprises an elongated strip having said lateral guide faces along opposite side edges thereof, and means supporting the strip for limited shifting of the strip laterally relative to the channel to allow centering of the strip between the rail engaging fingers.

* * * * *